US006327222B1

(12) United States Patent
Yamaya

(10) Patent No.: US 6,327,222 B1
(45) Date of Patent: Dec. 4, 2001

(54) ELECTRONIC WATCH

(75) Inventor: Daisuke Yamaya, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/558,617

(22) Filed: Apr. 26, 2000

(51) Int. Cl.[7] ..... G04F 10/00
(52) U.S. Cl. ..... 368/107; 368/155
(58) Field of Search ..... 368/107, 250, 368/251, 621, 155

(56) References Cited

U.S. PATENT DOCUMENTS 4,257,116 * 3/1981 Asano et al. ..... 368/69
4,283,784 * 8/1981 Horan ..... 368/87
4,348,743 * 9/1982 Dozier ..... 368/107
4,518,267 * 5/1985 Hepp ..... 368/107

* cited by examiner

*Primary Examiner*—Bernard Roskoski
(74) *Attorney, Agent, or Firm*—Adams & Wilks

(57) ABSTRACT

An output of an oscillation circuit is inputted to a frequency dividing circuit, and through the signals divided by the frequency dividing signal circuit 104, an interrupt signal circuit 104 starts to operate to generate an interrupt signal to a CPU. The CPU reads the data programmed in a ROM and performs various arithmetic operations. A flag management circuit outputs a determination flag for collectively determining either a plurality of conditional branch operations or a portion of the branch condition operations.

15 Claims, 3 Drawing Sheets

ELECTRONIC WATCH

BACKGROUND OF THE INVENTION

1. Field of the Invention

The present invention relates to an electronic watch mounted with a microcomputer, and particularly to a multifunctional electronic watch in which consumed electric power is cut down.

2. Description of the Prior Art

Conventionally, an electronic watch mounted with a microcomputer determines if various conditions for the operation of moving hands such as if a stem of the watch is wound or not, and if the watch is in a time display mode or not are satisfied in every operation of moving hands. In order to make these determinations, a flag confirmation is conducted and a corresponding process is executed when the flag matches with a branch condition. Subsequently, a confirmation is conducted on the next flag condition in the next branch and if the electronic watch is multifunctional, these operations were repeated a number of times.

As an electronic watch becomes more multifunctional, the number of times to make a determination and to branch increases, and the number of times to confirm a flag increases. Further, when the operation of moving hands is conducted every second, the above operations are also conducted every second.

However, a conventional electronic watch mounted with a microcomputer confirms whether the flags match with the various branch conditions before performing the operation of moving hands, and executes. Because of this, the operation before the moving of hands becomes longer leading to a problem in that as an electronic watch becomes more multifunctional, the operations of the above takes a longer time. As a result, a period of time during which a CPU is operative becomes longer, an operating electric current of a CPU increases, and there is more consumed electric current of an IC. For instance, a current is approximately 5.0 mA at an operating time of the CPU while it is 0.5 mA at a stand by time. In an electronic watch, a hand is normally moved once per second. Thus the longer operating time of the CPU causes the life of a battery of a watch to be shortened.

In order to solve the foregoing problem, an electronic watch according to the present invention comprises an oscillation circuit; a system clock generating circuit for generating a system clock from the output of the oscillation circuit; a frequency dividing circuit for dividing the output of the oscillation circuit; a ROM in which processing procedures such as chronological operations of a watch are programmed; a CPU for reading the data programmed in the ROM and for performing various arithmetic operations; an interrupt signal generating circuit for generating an interrupt signal to the CPU; a RAM for storing various kinds of data; and a flag management circuit for determining the state of a flag that becomes a branch condition during an arithmetic operation performed by the CPU.

In this structure, when the CPU reads data programmed in the ROM to perform various arithmetic operations, the CPU recognizes the state of a flag in the flag management circuit before performing an arithmetic operation. Therefore, when it is not necessary to perform a determination branch operation other than the movement of hands during the arithmetic operation, the operation of moving hands can be carried out without having to sequentially determine the branch conditions. A portion of the determination branch operation can be collectively determined such that the operation of moving hands can be carried out without having to make a sequential determination on all the branch conditions. Further, by providing a switch means, when it is not necessary to use the flag management circuit, it can be used as a general register to enhance the storage capacity and the operational ability of an arithmetic operation.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
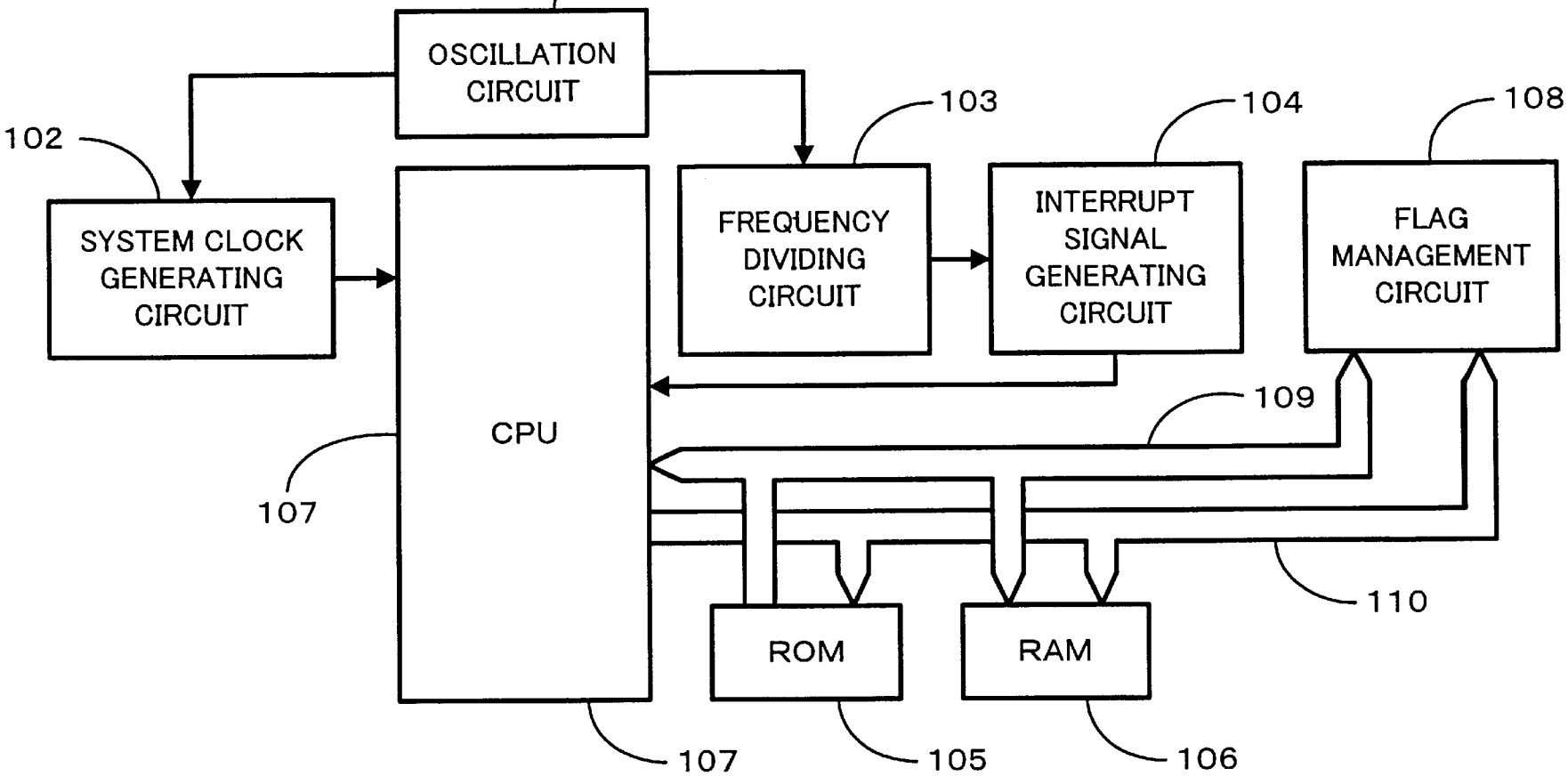
FIG. 1 is a functional block diagram showing one example of an electronic watch according to the present invention.

FIG. 1 is a functional block diagram showing one example of a representative structure of the present invention. In FIG. 1, an output of an oscillation circuit 101 is inputted to a system clock generating circuit 102. A system clock generated by the system clock generating circuit 102 is inputted to a CPU 107 whereby the CPU 107 starts to operate and various arithmetic operations are performed. The output of the oscillation circuit 101 is also inputted to a frequency dividing circuit 103. An interrupt signal generating circuit 104 starts to operate due to a signal divided by the frequency dividing circuit 103 and generates an interrupt signal to the CPU 107. The CPU 107 reads the data programmed in the ROM to perform various arithmetic operations.

A flag management circuit 108 is used as follows. When each frequency dividing signal divided by the frequency dividing circuit 103 is inputted to the interrupt signal circuit 104, the interrupt signal circuit 104 outputs an individual interrupt signal corresponding to each frequency dividing signal. When an interrupt signal is inputted to the CPU 107, the CPU 107 then goes into an interrupt operation. At this time, an address of a ROM 105 is decided first according to the interrupt type of interrupt signal. Then programming data are transmitted to the CPU 107 via a data bus 109. The CPU 107 reads this programming data and various arithmetic operations are performed. In the course of reading and processing the programming data, the flag management circuit 108 outputs either a management bit for making a collective determination when a plurality of conditional branch operations are contained, or a management bit for making a collective determination only for a portion of a plurality of conditional branch operations.

Figure 2:
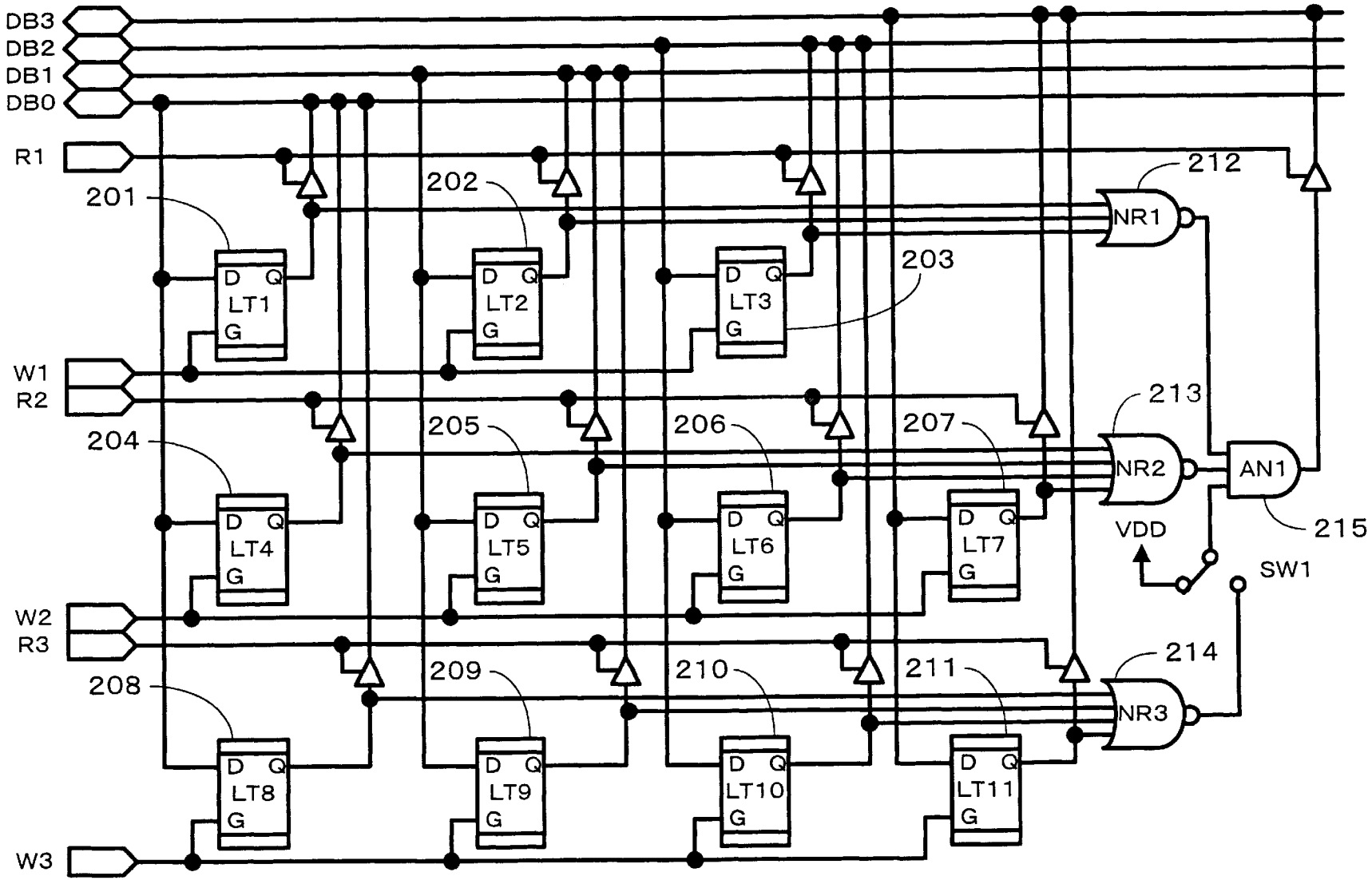
FIG. 2 is a circuit diagram illustrating a circuit structure according to the present invention.

FIG. 2 is a detailed circuit diagram of the flag management circuit 108 of an electronic watch according to the present invention. Latch circuits 201 through 207 indicate bit data of the flags managed by the flag management circuit 108, and in response to data of data bus DB3 through DB0 and write signals W1 and W2 that are to be selected by the CPU 107, data are written. The written data are inputted to NOR gates 212 and 213 and their respective outputs are then inputted to an AND gate 215. The output of this AND gate 215 operates as a management bit and when the flag data of the latch circuits 201 through 207 are all 0, 1 is outputted to the data bus DB3 by a read signal R1.

Further, by connecting an SW1 to the output of a NOR gate 214, 11 bit of the flag data that includes the flag data of latch circuits 208 through 211 can be managed by the management bit.

In a state where the SW1 is connected to a VDD, the latch circuits 208 through 211 can also be used as general registers.

Though not shown in the figure, the management bit is not a management bit for managing all the latch circuits but may be adopted to manage a portion of the latch circuits. The management bit can also be adopted as a management bit for managing each of a plurality of sets into which all the latch circuits are divided. Furthermore, a combination of a management bit that collectively manages all the latch circuits a management bit that manages a plurality of sets can be adopted.

Figure 3:
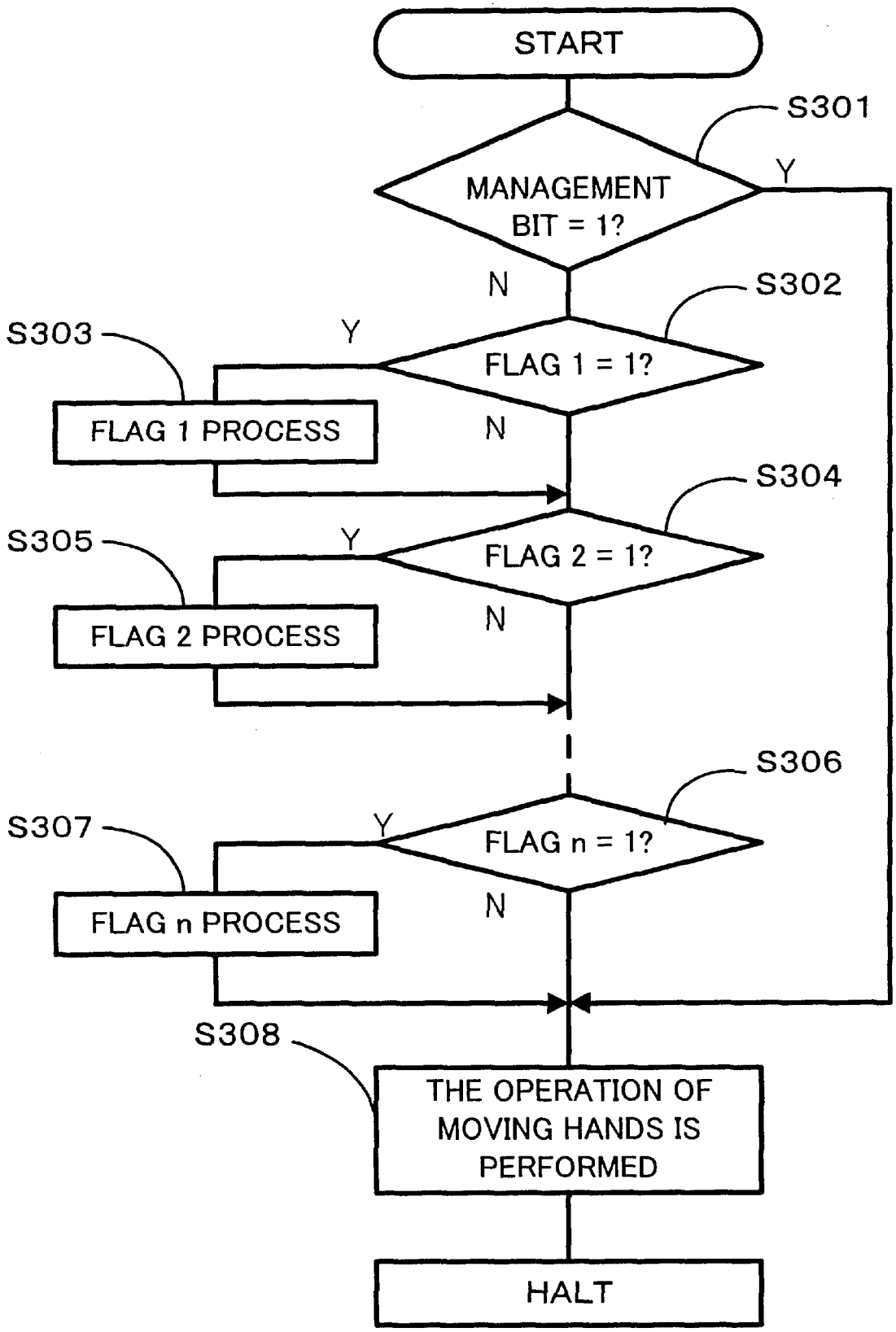
FIG. 3 is a flowchart showing an operating method of an electronic watch according to the present invention.

FIG. 3 is a flow chart illustrating an operation of the flag management circuit 108 of an electronic watch according to the present invention. In FIG. 3, when an interrupt signal from the interrupt signal generating circuit 104 is inputted to the CPU 107, the CPU goes into an interruption operation to determine whether the management bit of the flag management circuit 108 is 1 or not (S301). If the management bit is equal to 1, the operation of moving hands is performed (S308). On the other hand, if the management bit is not equal to 1, a determination is made as to whether a conditional branch flag 1 is equal to 1 or not (S302). If the conditional branch flag 1 is equal to 1, the operation of the conditional branch flag 1 is carried out (S303) and a determination is made as to whether a conditional branch flag 2 is equal to 1 or not (S304). If the conditional branch flag 1 is not equal to 1, a determination is made as to whether a conditional branch flag 2 is equal to 1 or not (S304). The operation of the conditional branch flag 2 is carried out if the conditional branch flag 2 is equal to 1 (S305), and a determination is made as to whether a next conditional branch flag 2 is equal to 1 or not. On the other hand, if the conditional branch flag 2 is not equal to 1, a determination is made as to whether the conditional branch flag 2 is equal to 1 or not. The following processing continues in the same manner. A determination is made as to whether a conditional branch flag n is equal to 1 or not (S306). If the condition branch flag n is equal to 1, then the conditional branch flag n is processed (S307) and the operation of moving hands is then performed (S308). Conversely, if the conditional branch flag n is not equal to 1, the operation of moving hands is performed (S308). After performing the operation of moving hands (S308), the process goes into a HALT operation.

With the above-mentioned operation, a plurality of branch processes made in a conventional electronic watch can be omitted because of a collective determination attained by a management bit, and the operating time of the CPU 107 can be reduced and consumed electric current can be lessened when all the conditional branch flags are equal to 0.

The present invention is implemented according to the above-explained embodiment and has an effect mentioned hereinbelow.

An electronic watch having a flag management circuit for making determinations on the state of the flags which become branch conditions during an arithmetic operation performed by a CPU will not have to make a sequential determination on the flags that become branch conditions, and can exclude branch processing that is no longer necessary. Therefore, the operating time of the CPU can be reduced and the life of a battery can be extended.

Further, by collectively managing the flags that become the branch conditions to be managed by the flag management circuit, the operating time of the CPU until the operation of moving hands can be reduced since a collective process can be performed without having to make a sequential determination on the flags that become branch conditions when the branching is no longer necessary.

Still further, by collectively managing a portion of the branch conditions to be managed by the flag management circuit, a portion of the branch conditions can be collectively processed, and in that portion it is not necessary to make a sequential determination on the flags that become branch conditions, so that the branch conditions that are no longer necessary can be excluded.

When the branch conditions to be processed are no long necessary, a collective management can be carried out by combining the collective management of the flags that become branch conditions to be managed by the flag management circuit with the collective management of a portion of the branch conditions to be managed by the flag management circuit. Contrarily, even if the branch conditions to be processed becomes necessary, it is sufficient that only the portion that corresponds to the collective management of a portion thereof be processed since it is not necessary to make a sequential determination on the flags that become branch conditions. The operating time of the CPU can be lessened even in a situation where the branch conditions to be processed become necessary.

By providing a switch means, the flag management circuit can be used as a general register when it is not necessary to use the flag management circuit, and memory capacity and operating ability of the arithmetic operations can be enhanced. Further, the capacity of a ROM can be used effectively during a software development.

What is claimed is:

1. An electronic watch comprising:

an oscillation circuit;

a system clock generating circuit for generating a system clock based on the output of the oscillation circuit;

a frequency dividing circuit for dividing the output of the oscillation circuit;

a ROM for storing programs including a program for performing chronological operations of the watch;

a CPU for reading the programs stored in the ROM and performing various arithmetic operations in accordance with the programs;

an interrupt signal generating circuit for supplying an interrupt signal to the CPU;

a RAM for storing various kinds of data generated by the CPU; and a flag management circuit for collectively determining the state of a plurality of flags each of which indicates a branch condition for causing the CPU to branch to a program corresponding to the respective flag during an arithmetic operation performed by the CPU.

2. An electronic watch as claimed in claim 1; wherein the flag management circuit produces a management bit for indicating whether any of the plurality of flags indicates a branch condition.

3. An electronic watch as claimed in claim 1; wherein the flag management circuit produces a management bit for indicating whether a portion of the plurality of flags indicates a branch condition.

4. An electronic watch as claimed in claim 1; wherein the flag management circuit produces a management bit for indicating whether at least one of a portion of the plurality of flags indicates a branch condition.

5. An electronic watch according to claim 1; further comprising switch means connected to an output of the flag management circuit for enabling use of the flag management circuit as a general register.

6. An electronic watch according to claim 2; further comprising switch means connected to an output of the flag management circuit for enabling use of the flag management circuit as a general register.

7. An electronic watch according to claim 3; further comprising switch means connected to an output of the flag management circuit for enabling use of the flag management circuit as a general register.

8. An electronic timepiece as claimed in claim 1; wherein the flag management circuit comprises a plurality of latch circuits for storing individual flag values and a logic circuit for performing a logical operation on outputs of the latch circuits to indicate when any one of the flags indicates a branch condition.

9. An electronic timepiece as claimed in claim 1; wherein the flag management circuit comprises a plurality of latch circuits for storing individual flag values and a logic circuit for performing a logical operation on outputs of less than all of the plurality of latch circuits to indicate when any of the corresponding flags indicates a branch condition.

10. An electronic timepiece as claimed in claim 1; wherein the CPU performs an interrupt process in response to the interrupt signal by checking the flag management circuit to determine the status of the flags.

11. An electronic timepiece comprising: a data processing circuit for performing arithmetic operations including timekeeping operations and driving a display to indicate time; an interrupt signal generating circuit for supplying an interrupt signal to the data processing circuit to control the data processing circuit to perform a flag status checking operation; and a flag management circuit for collectively determining the status of a plurality of flags each of which indicates a branch condition for causing the data processing circuit to branch to a program corresponding to the respective flag.

12. An electronic timepiece according to claim 11; wherein the data processing circuit comprises an oscillation circuit, a system clock generating circuit for generating a system clock based on an output of the oscillation circuit, a frequency dividing circuit for dividing an output of the oscillation circuit, a ROM for storing programs, a CPU for reading the programs stored in the ROM and performing various arithmetic operations in accordance therewith and a RAM for storing data generated by the CPU.

13. An electronic timepiece according to claim 11; wherein the flag management circuit produces a management bit for indicating whether any of the plurality of flags indicates a branch condition.

14. An electronic timepiece according to claim 11; wherein the flag management circuit comprises a plurality of latch circuits for storing individual flag values and a logic circuit for performing a logical operation on outputs of the latch circuits to indicate when any one of the flags indicates a branch condition.

15. An electronic timepiece according to claim 11; further comprising a switch connected to an output of the flag management circuit for enabling use of the flag management circuit as a general purpose register.

* * * * *